United States Patent [19]

Wheeler

[11] 4,355,098

[45] Oct. 19, 1982

[54] SUPERSENSITIZING DIRECT POSITIVE DYE COMBINATIONS

[75] Inventor: James W. Wheeler, Fairport, N.Y.

[73] Assignee: E. I. Du Pont de Nemours and Company, Wilmington, Del.

[21] Appl. No.: 233,657

[22] Filed: Feb. 11, 1981

[51] Int. Cl.[3] ..... G03C 5/24

[52] U.S. Cl. ..... 430/510; 430/596; 430/597; 430/573; 430/574; 430/576; 430/577; 430/589; 430/587

[58] Field of Search ..... 430/572, 574, 576, 577, 430/573, 589, 510, 596, 569, 597, 587

[56] References Cited

U.S. PATENT DOCUMENTS

| | | | |
|---|---|---|---|
| 3,501,306 | 3/1970 | Illingsworth | 430/596 |
| 3,539,349 | 11/1970 | Brooke et al. | 430/547 |
| 3,615,608 | 10/1971 | Van Lave | 430/597 |
| 3,759,713 | 9/1973 | Florens et al. | 430/577 |
| 3,772,030 | 11/1973 | Gilman et al. | 430/587 |
| 3,826,656 | 7/1974 | Jenkins et al. | 430/547 |

*Primary Examiner*—Won H. Louie, Jr.

[57] ABSTRACT

Direct positive photographic elements with improved spectral sensitivity in the green and red portion of the visible spectrum are obtained from emulsions containing a supersensitizing amount of a spectral sensitizing dye (a) having a solution absorption maximum less than 495 nm and the lowest vacant energy band less than −3.7 eV, and a sensitizing amount of a spectral sensitizing dye (b) having a lowest vacant energy band between −3.7 eV and 0.3 eV below the lowest vacant energy band of said spectral sensitizing dye (a) and with the highest occupied energy band between −5.9 eV and 0.3 eV above the highest occupied energy level of dye (a).

5 Claims, No Drawings

SUPERSENSITIZING DIRECT POSITIVE DYE COMBINATIONS

FIELD OF THE INVENTION

This invention relates to direct positive, photographic silver halide elements with improved spectral sensitivity.

BACKGROUND ART

The prior art describes a host of dye systems which can be used in the photographic industry to extend the spectral sensitivity of silver halide elements. A light-sensitive silver halide emulsion is spectrally sensitized when it is rendered more sensitive by addition of dyes which absorb certain portions of the spectrum. These dyes are described as sensitizers for both negative-working and positive-working (direct positive) silver halide systems. Certain combinations of dyes can be added to negative-working systems to cause a so-called "supersensitizing" effect. Supersensitization usually results in speed and spectral extension of the emulsion beyond that which might be predicted from a simple arithmetic addition of the individual effects produced by each dye alone. Supersensitization is an old phenomenon in the negative-working silver halide industry. A good review of this subject is found, for example, in Gilman et al, J. Photogr. Sci., Vol. 21, pages 53–70 (1973). Supersensitization of direct positive emulsions using dye pairs is also known in the prior art.

SUMMARY OF THE INVENTION

This invention resides in employing a combination of spectral sensitizing dyes to supersensitize a direct positive silver halide element comprising a support and at least one direct positive silver halide emulsion layer coated thereon, said emulsion comprising fogged, gelatino-silver halide grains. This dye combination provides improved spectral sensitivity in the green and red portion of the visible spectrum. This dye combination is a dye pair consisting of a supersensitizing amount of a spectral sensitizing dye (a), hereafter referred to as the "supersensitizing dye", having a solution absorption maximum less than 495 nm, and with its lowest vacent energy band being less than −3.7 eV, and in combination therewith a sensitizing amount of a spectral sensitizing dye (b) having a lowest vacant energy band between −3.7 eV and 0.3 eV below the lowest vacant energy band of said supersensitizing dye (a) and with the highest occupied energy band of said dye (b) between −5.9 eV and 0.3 eV above the highest occupied energy level of dye (a), wherein dye (b) above is one of the following:

I.

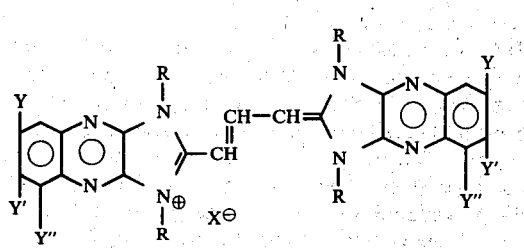

wherein

Y and Y′ may be —H, —Cl or —$NO_2$;

Y′ and Y″ together may be phenyl; R may be alkyl (e.g., —$CH_3$, —$CH_2$—$CH_3$, propyl, butyl); phenyl; alkenyl, e.g., —$CH_2$—CH=$CH_2$; or hydroxyalkyl, e.g. —$CH_2$—$CH_2$—OH; and X is an anion such as $Cl^{\ominus}$, $Br^{\ominus}$, p-toluene sulfonate, ($PTS^{\ominus}$), $ClO_4^{\ominus}$, and tetraphenyl borane ($BPh_4^{\ominus}$);

II.

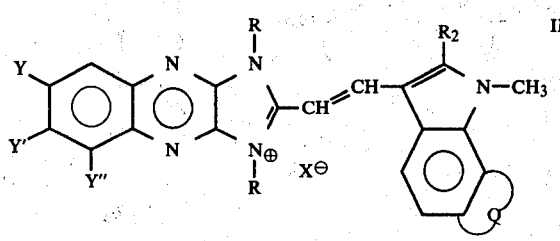

wherein $R_2$ may be

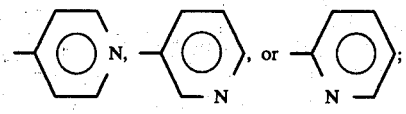

and

Q represents sufficient carbon atoms to form a phenyl group;

III.

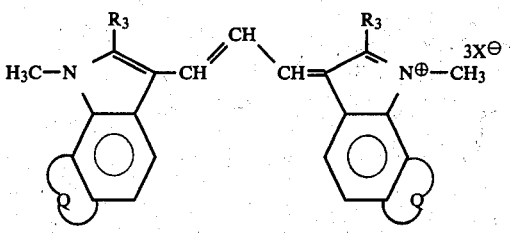

wherein

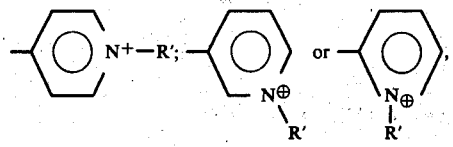

and R′ is —H or alkyl, e.g., —$CH_3$;

IV.

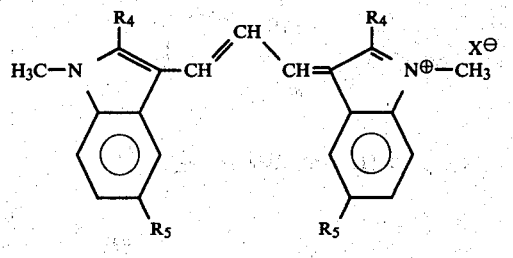

wherein

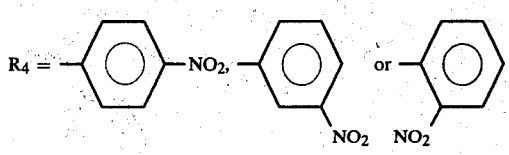

and $R_5$=—H or —$NO_2$;

V.

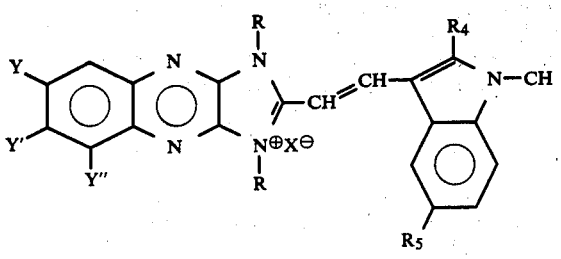

or

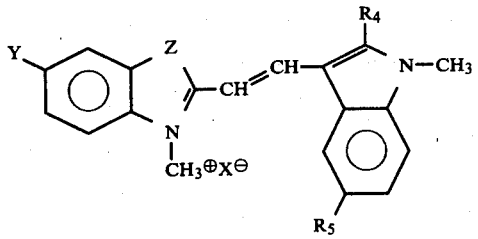

wherein Z=S or $C(CH_3)_2$;

VI.

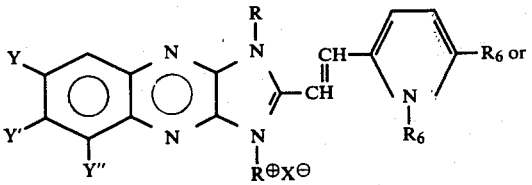

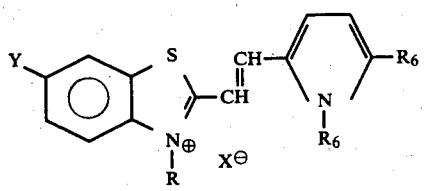

wherein $R_6$=H, $—CH_3$, or aryl,

VIII.

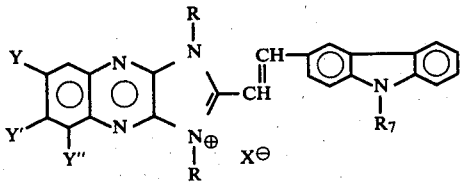

wherein $R_7$=$—CH_3$, or $—CH_2—CH_3$;

VIII.

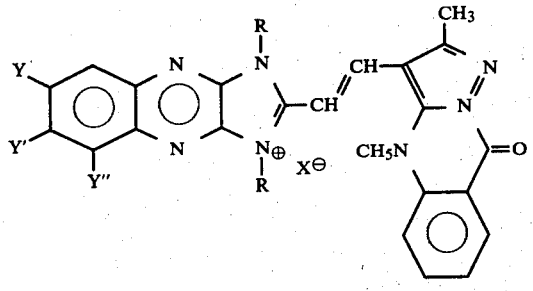

-continued

IX.

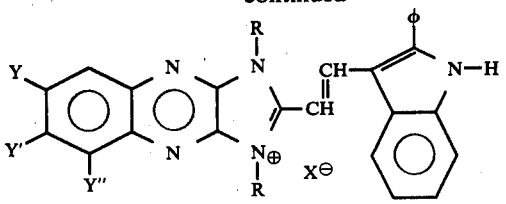

and supersensitizing dye (a) is one of the following:

A.

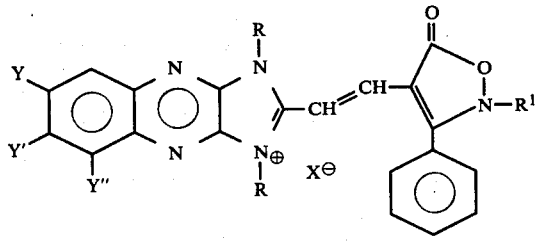

B.

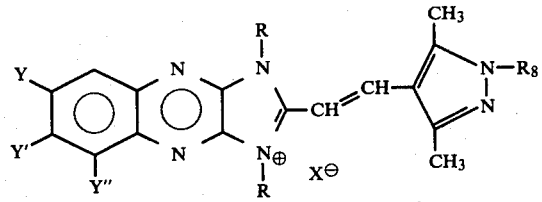

wherein $R_8$=$—CH_3$, phenyl, or

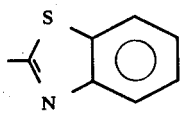

and

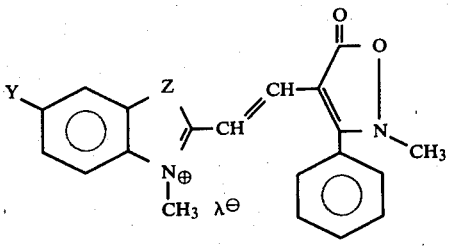

Dyes from the above referenced structures are usually made up in dilute alcohol solutions and are added to the emulsions in a range of about 0.01 g. to 1.2 g. per 1.5 mole of silver halide in the case of dyes I–X, and 1.0 g. to 2.2 g. per 1.5 mole of silver halide in the case of supersensitizing dyes A, B, or C.

Dye combinations useful within the limit of this invention may be selected by measuring the polarographic half wave potential of a solution and the absorption maximum (λmax) in methanol. The supersensitizing dye (a), A, B or C, will have the lowest vacant energy band ($E_{LVSS}$) less than −3.7 eV and a λmax less than 495 nm; while the spectral sensitizing dye (b), I–X, will have a lowest vacant energy band ($E_{LVdye}$) between −3.7 eV and 0.3 eV below $E_{LVSS}$ and will have the highest occupied energy band ($E_{HOdye}$) between −5.9 eV and 0.3 eV above the highest occupied energy level of the supersensitizing dye ($E_{HOSS}$). Thus, mathematically, $E_{LVSS} < -3.7$ eV and $E_{LVSS} - E_{HOSS} > 2.5$ eV and $-3.7$ eV $E_{LV}$ dye $> E_{LVSS} - 0.3$ eV $-5.9$ eV $E_{HO}$ dye $> E_{HOSS} + 0.3$ eV Typical positive-working, gelatino-silver halide emulsions useful in the practice of this invention are legion in number and description. It is preferred to use silver bromo-iodide prepared from a balanced, double-jet-type precipitation (about 0.2μ edge length) containing about $8 \times 10^{-5}$ mole percent rhodium in about 190 g. gelatin per mole of silver halide. These emulsions are fogged with cesium thiadecaborane and hydrochloroauric acid and contain sensitizing adjuvants such as polyethylene oxides, etc. The emulsion is usually coated at about 0.4–3 g. Ag/m$^2$ coating weight on a paper or a polyester base containing an antihalation backing layer, and the emulsion hardened with formaldehyde. Preferred dyes are:

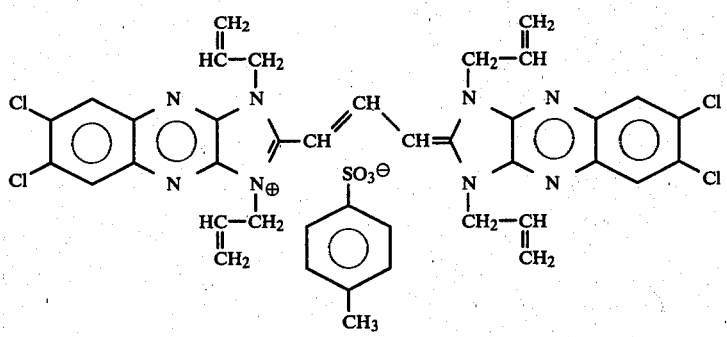

symmetrical imidazoquinoxaline carbocyanine, a red sensitizer representative of (b)-I where:

λmax (methanol = 470 nm $E\ \frac{1}{2} = -0.53$ $E_{LV} = -3.89$; $E_{HO} = -5.94$ and,

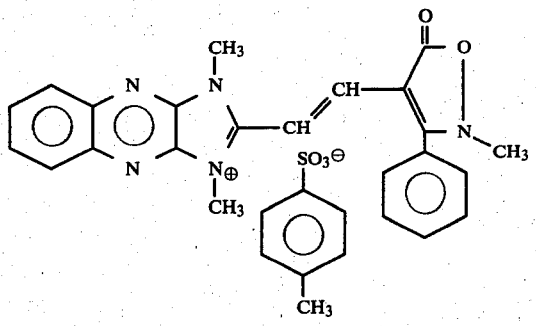

imidazoquinoxaline 5-oxoisoxazoline carbocyanine, a supersensitizing dye representative of (a)-A, where:

λmax = 410 nm $E\ \frac{1}{2} = -0.49$ $E_{LV} = -3.93$ and $E_{HO} = -6.95$

In a specific embodiment these dyes were added to the foregoing emulsion after chemical digestion and just before coating at 0.5 g./1.5 moles of silver halide of the red sensitizer and 2.0 g./1.5 moles of silver halide of the supersensitizing dye. The speed of the film prepared from this emulsion was increased about 40% and a factor known as "negative rebuild" was reduced about 50% over a control emulsion with only the red sensitizer. Negative rebuild is an undesirable phenomenon which occurs when a direct positive film, which should give decreasing density with increasing exposure, exhibits increased density at high intensity exposure (e.g., a negative image).

As stated above, these emulsions may be coated on a polyester or paper support, but it is preferable to use 0.004 inch thick polyethylene terephthalate film coated on both sides with the sub layer of Rawlins, U.S. Pat. No. 3,443,950 (vinylidene chloride/alkyl acrylate/itaconic acid copolymer mixed with an alkyl acrylate and/or methacrylate polymer) overcoated with a thin substratum of gelatin. A conventional antihalation layer is preferably applied on one side and the sensitized, fogged emulsion of this invention on the opposite side of the film support. After drying, film strip samples can be tested by a $10^{-3}$ second exposure through a $\sqrt{2}$ step wedge on the Mark 6 Sensitometer made by E. G. and G. Co. which uses the GE type FT-118 Xenon Flash Tube. After exposure, the strips may be developed in any conventional developer (e.g., mixed hydroquinone/phenidone developing agent). One preferred developer contains the following ingredients:

| Ingredient | Amt. (g/l) |
|---|---|
| Sodium Metaborate | 19.8 |
| Sodium Sulfite | 244.4 |
| Sodium Carbonate | 35.7 |
| Sodium Hydroxide (45% soln.) | 151.9 |
| 5-Nitrobenzimidazole | 0.09 |
| Benzotriazole | 0.92 |
| 1-Phenyl-5-Mercaptobenzotriazole | 0.10 |
| Hydroquinone | 111.0 |
| Phenidone | 5.95 |
| Potassium Bromide | 5.35 |
| pH | 11.6–12.0 |

Additional wetting agents, sequestrants, and adjuvants may also be incorporated in the developer, as known to those skilled in the art. Typically, the exposed strips are developed for about 30 seconds in the above developer at 95° F. followed by a 50 second water wash, and fixed for 30 seconds in a conventional ammonium thiosulfate fixer at a pH of about 5.4 and a temperature of 95° F. The fixed element is then washed 30 seconds in water and dried.

The following dye pairs were also tested to further exemplify the invention:

| Example | Red Dye | Amt. (g./1.5 mole AgX) | Supersen. Dye | Amt. | Red Speed Incr. (%)(1) | Neg. Rebuild Decr. (%)(1) |
|---|---|---|---|---|---|---|
| 1 | 1 | 0.5 | 2 | 2.0 | 40 | 50 |
| 2 | 1 | 0.5 | 3 | 1.3 | 85 | 60 |
| 3 | 4 | 0.3 | 2 | 1.3 | 17 | — |
| 4 | 5 | 0.7 | 2 | 1.3 | 8 | — |
| 5 | 11 | 0.7 | 6 | 0.8 | 170 | — |
| 6 | 7 | 0.03 | 2 | 1.3 | 90 | 25 |

-continued

| Example | Red Dye | Amt. (g./1.5 mole AgX) | Supersen. Dye | Amt. | Red Speed Incr. (%)(1) | Neg. Rebuild Decr. (%)(1) |
|---|---|---|---|---|---|---|
| 7 | 7 | 0.03 | 8 | 1.3 | 45 | 62 |
| 8 | 9 | 0.3 | 2 | 1.3 | 96 | 90 |
| 9 | 10 | 0.7 | 2 | 1.3 | 120 | 50 |

(1)over red dye alone

Dye Structures for Examples 1–10 are:

1. Symmetrical imidazoquinoxaline carbocyanine, described above.

2.

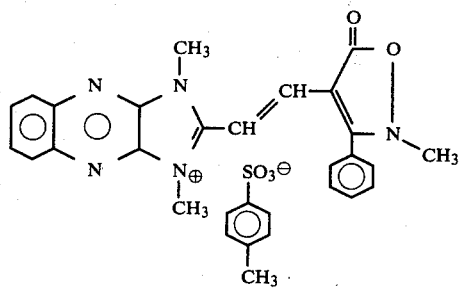

max = 410
$E_{\frac{1}{2}}$ = −.49
$E_{LV}$ − −3.93
$E_{HO}$ = −6.95

3.

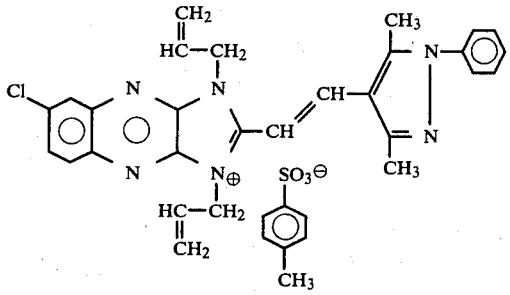

λ max = 425
$E_{\frac{1}{2}}$ = −.53
$E_{LV}$ = −3.89
$E_{HO}$ = −6.81

4.

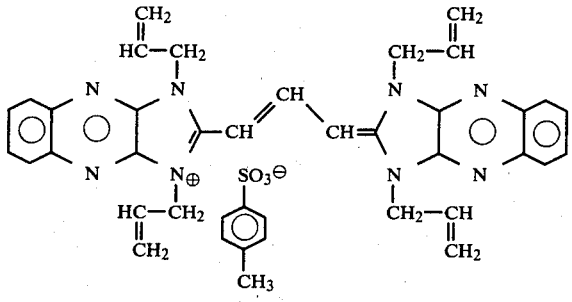

λ max = 580
$E_{\frac{1}{2}}$ = −.46
$E_{LV}$ = −3.96
$E_{HO}$ = −6.10

5.

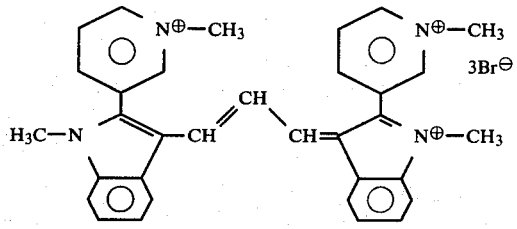

λ max = 585
$E_{\frac{1}{2}}$ = −.39
$E_{LV}$ − −4.03
$E_{HO}$ = −6.15

-continued
6.
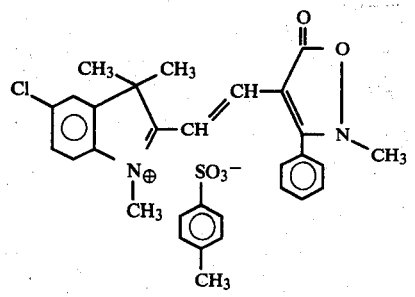
λ max = 425
E ½ = −.53
$E_{LV}$ = −3.89
$E_{HO}$ = −6.82
7.
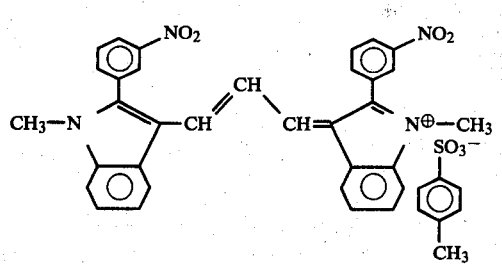
λ max = 585
E ½ = −.39
$E_{LV}$ = −4.03
$E_{HO}$ = −6.15
8.
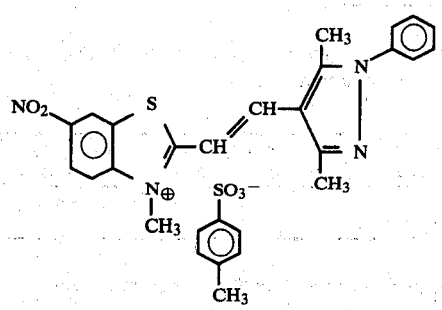
λ max = 425
E ½ = −.55
$E_{LV}$ = −3.87
$E_{HO}$ = −6.79
9.
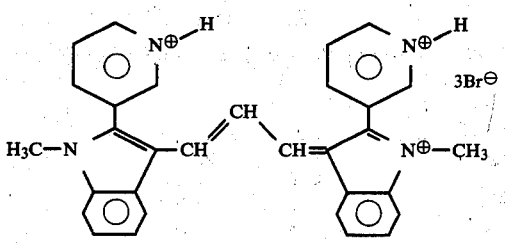
λ max = 585
E ½ = −.39
$E_{LV}$ = −4.03
$E_{HO}$ = −6.15
10.
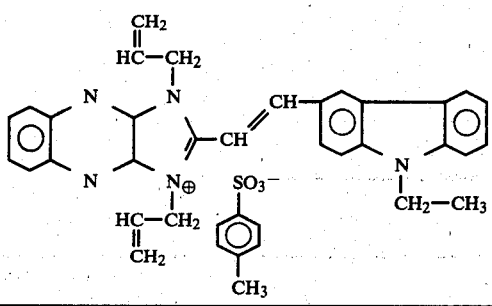
λ max = 500
The following examples demonstrate that dyes having energy bands $E_{LV}$ or $E_{HO}$ outside the limits of this invention will not function:
EXAMPLE 10

11.

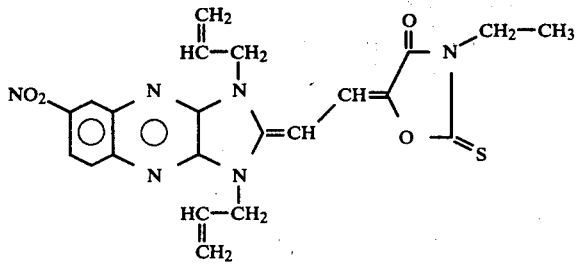

λ max = 500
E ½ = −0.7
$E_{LV}$ = −3.70
$E_{HO}$ = −6.20

12.

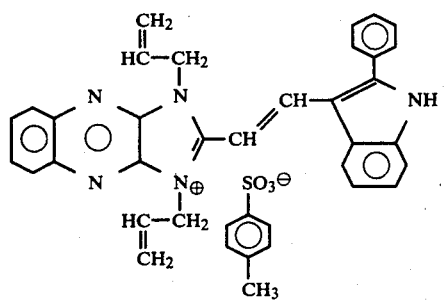

λ max = 505
E ½ = −0.64
$E_{LV}$ = −3.78
$E_{HO}$ = −6.23

The following results were obtained when these dyes were evaluated along with Supersensitizing Dye 2 in a direct positive emulsion:

| Red Dye | Amt. (g/1.5 mole AgX) | Red Speed |
|---|---|---|
| 11 | 2.0 | no reversal |
| 12 (control) | 1.5 | 10 |

This example shows that the $E_{LV}$ must be more negative than −3.7 for the dye to show reversal.

EXAMPLE 11

The following dye was evaluated in this example:

When tested in a direct positive emulsion, the following results were obtained:

| Red Dye | Amt. (g/1.5 mole AgX) | Red Speed Incr. (%) |
|---|---|---|
| 13 | 2.0 | no reversal |
| 1 - (control) | 0.5 | 165 |

This example shows that $E_{HO}$ must be more negative than −5.9 for reversal to occur.

EXAMPLE 12

The following dyes were evaluated in this example:

13.

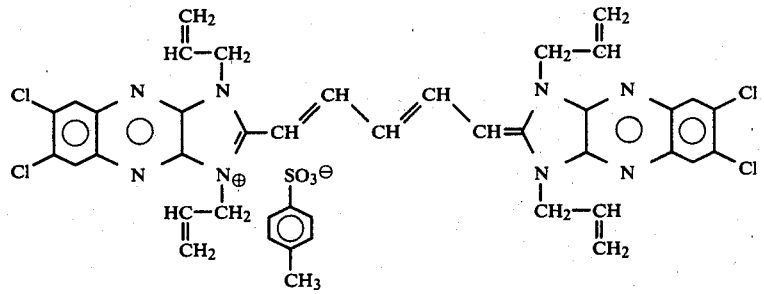

λ max = 690
E ½ = −0.33
$E_{LV}$ = −4.09
$E_{HO}$ = −5.89

14.

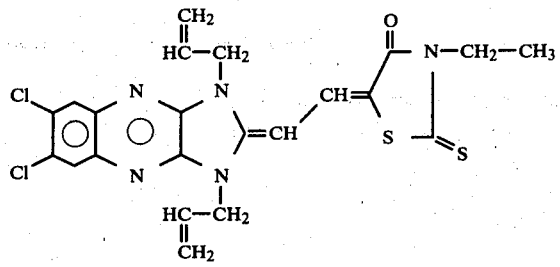

λ max = 410
E ½ = −.53
$E_{LV}$ = −3.89
$E_{HO}$ = −6.91

-continued

| | |
|---|---|
| 15. 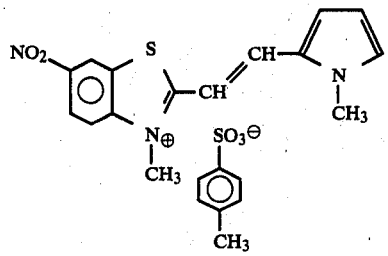 | λ max = 495<br>E ½ = −.35<br>$E_{LV}$ = −4.07<br>$E_{HO}$ = −6.57 |

Both of these dyes were tested along with Supersensitizing Dye 2 in a direct positive emulsion, with the following results:

| Dye | $E_{HO}$ | Amt. (g.1.5 mole AgX) | Supersens. Dye $E_{HO}$ | Speed Incr. (%) |
|---|---|---|---|---|
| 14 | −6.91 | 1.0 | −6.95 | 0 |
| 15 (control) | −6.57 | 0.3 | −6.95 | 80 |

This example shows that no supersensitization occurs if the supersensitizing dye (a) has an $E_{HO}$ more negative than $0.3+E_{HO}$ of the spectral sensitizing dye (b).

I claim:

1. A direct positive silver halide element comprising a support and at least one direct positive silver halide emulsion coated thereon, said emulsion comprising fogged, gelatino-silver halide emulsion grains and a pair of sensitizing dyes providing improved spectral sensitivity in the green and red portion of the visible spectrum, characterized in that said dye pair consists of a supersensitizing amount of a spectral sensitizing dye (a) having a solution absorption maximum less than 495 nm, and with its lowest vacant energy band being less than −3.7 eV, and in combination therewith a sensitizing amount of a spectral sensitizing dye (b) having a lowest vacant energy band between −3.7 eV and 0.3 eV below the lowest vacant energy band of said supersensitizing dye (a) and with the highest occupied energy band of said dye (b) between −5.9 eV and 0.3 eV above the highest occupied energy level of dye (a), wherein dye (b) above is one of the following:

I.

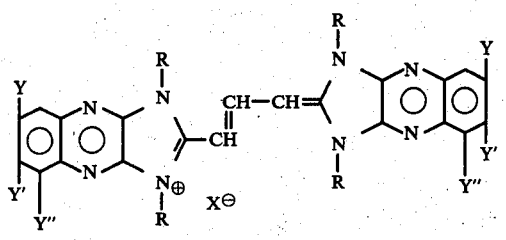

wherein

Y and Y′=—H, —Cl or —$NO_2$; Y″=—H, and Y′ and Y″ together=phenyl;

R=alkyl, phenyl, alkenyl, or hydroxyalkyl; and

X is an anion selected from the group consisting of $Cl^{\ominus}$, $Br^{\ominus}$, p-toluene sulfonate, ($PTS^{\ominus}$), $ClO_4^{\ominus}$, and tetraphenyl borane ($BPh_4^{\ominus}$);

II.

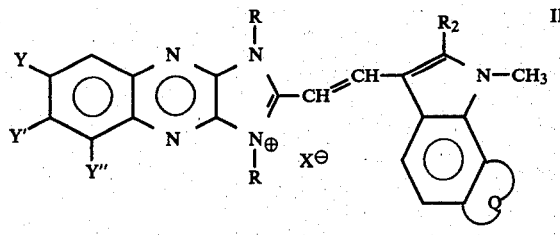

wherein

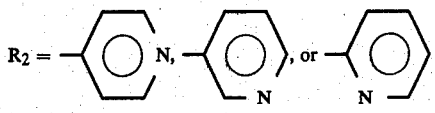

and

Q represents sufficient carbon atoms to form a phenyl group;

III.

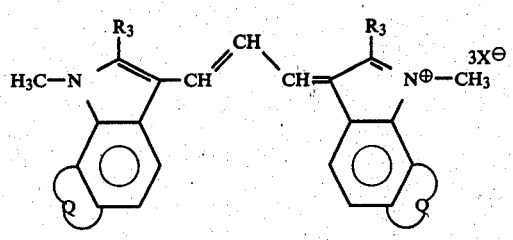

wherein

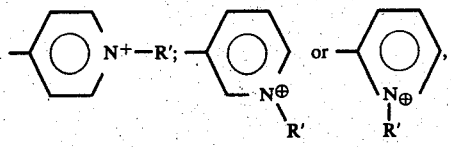

and

R′ is —H or alkyl, e.g., —$CH_3$;

IV.

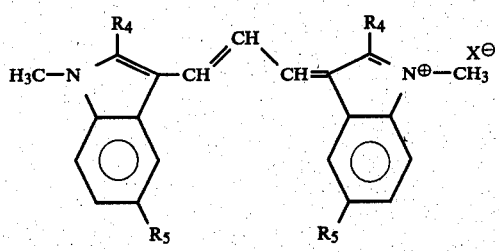

wherein

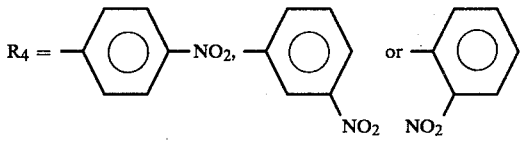

and $R_5$=—H or —$NO_2$;

V.

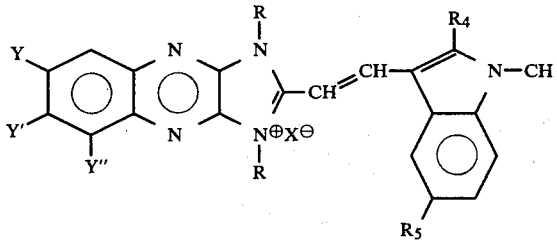

or

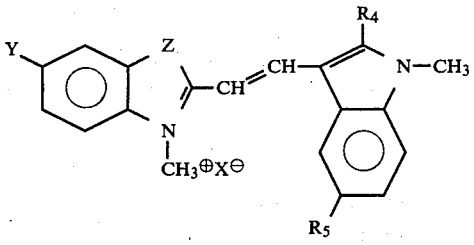

wherein Z=S or $C(CH_3)_2$;

VI.

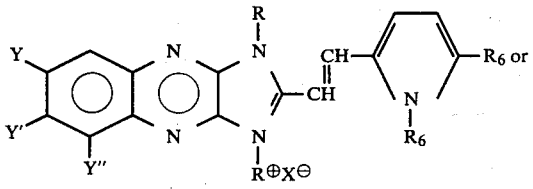

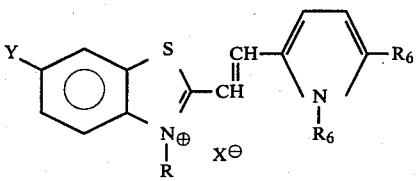

wherein $R_6$=H, —$CH_3$, or aryl;

VIII.

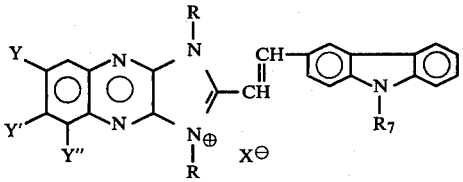

wherein $R_7$=—$CH_3$ or —$CH_2$—$CH_3$;

VIII.

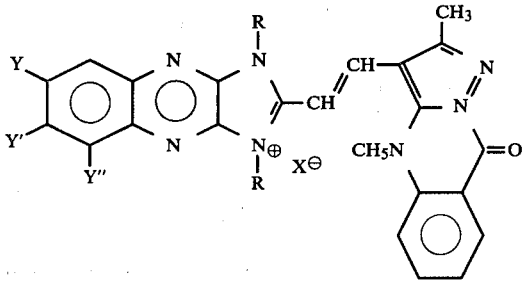

IX.

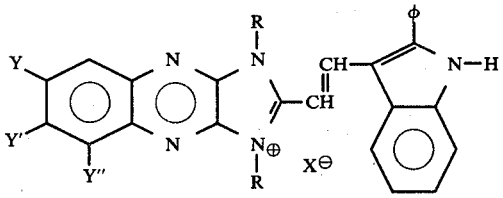

and supersensitizing dye (a) is one of the following:

A.

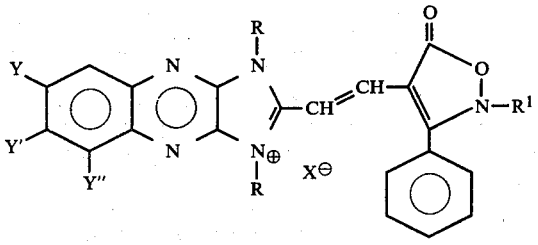

B.

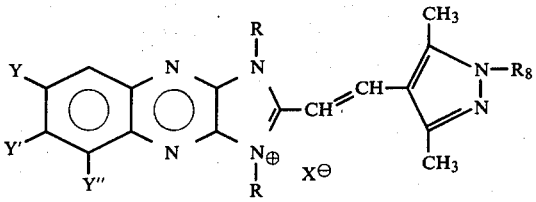

wherein $R_8$=—$CH_3$, phenyl, or

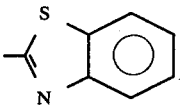

and

C.

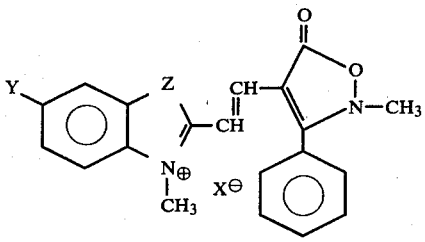

and wherein Y, Y′, Y″, R, R′, $R_4$, $R_5$, Z and X are as defined above.

2. The direct positive silver halide element of claim 1 wherein the dyes are added to the emulsion in an amount of about 0.01 g to 1.2 g per 1.5 moles of silver halide in the case of dye (a), and 1.0 g to 2.2 g per 1.5 moles of silver halide in the case of dye (b).

3. The direct positive silver halide element of claim 1 wherein dye (b) is symmetrical imidazoquinoxaline carbocyanine, and dye (a) is imidazoquinoxaline 5-oxoisoxazoline carbocyanine.

4. The direct positive silver halide element of claim 1 wherein the gelatino-silver halide emulsion is prepared by double jet precipitation.

5. The direct positive silver halide element of claim 1 wherein the direct positive silver halide emulsion is coated on one side of the support, and an antihalation layer is coated on the opposite side.

* * * * *

UNITED STATES PATENT AND TRADEMARK OFFICE

CERTIFICATE OF CORRECTION

PATENT NO. : 4,355,098

DATED : October 19, 1982

INVENTOR(S) : James W. Wheeler

It is certified that error appears in the above-identified patent and that said Letters Patent is hereby corrected as shown below:

| Column | Line | Correction |
|---|---|---|
| 14 | 46 | "wherein" should be --wherein $R_3$ = -- |
| 16 | 9 | In formula VIII |

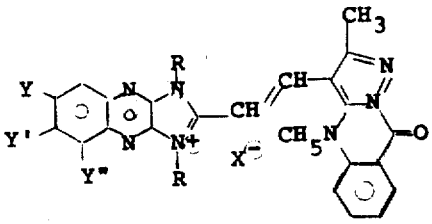

should be

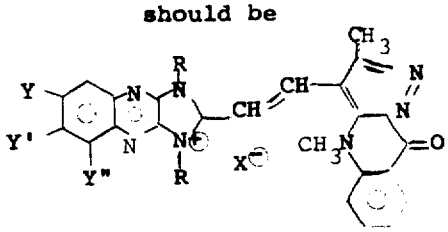

Signed and Sealed this

Twelfth Day of July 1983

[SEAL]

Attest:

GERALD J. MOSSINGHOFF

Attesting Officer

Commissioner of Patents and Trademarks